United States Patent [19]

Doi et al.

[11] Patent Number: 4,683,723

[45] Date of Patent: Aug. 4, 1987

[54] HEAT ACTIVATED HEAT PUMP

[75] Inventors: Yoshiki Doi, Kobe; Mitsuo Inabe, Funabashi; Osamu Noro, Akashi, all of Japan

[73] Assignee: Kawasaki Jukogo Kabushiki Kaisha, Hyogo, Japan

[21] Appl. No.: 877,964

[22] Filed: Jun. 24, 1986

[30] Foreign Application Priority Data

Mar. 25, 1986 [JP] Japan ..... 61-66620

[51] Int. Cl.[4] ..... F25B 9/00

[52] U.S. Cl. ..... 62/6; 60/520

[58] Field of Search ..... 62/6; 60/520, 517

[56] References Cited

U.S. PATENT DOCUMENTS 3,379,026 4/1968 Cowans ..... 62/6

4,455,841 6/1984 Wurm et al. ..... 62/6

*Primary Examiner*—Henry A. Bennet

*Attorney, Agent, or Firm*—Wenderoth, Lind & Ponack

[57] ABSTRACT

A heat pump has a hot displacer and a cold displacer disposed opposite to each other in a state wherein the two displacers are guided by two guide projections so as to form two gas springs, respectively, and the two displacers continue to move reciprocally due to change of pressure of working gas without any outer mechanical driving force.

7 Claims, 17 Drawing Figures

HEAT ACTIVATED HEAT PUMP

BACKGROUND OF THE INVENTION

This invention relates to a heat activated heat pump and particularly to a free piston version of so-called Vulleumier heat pump.

A type of conventional Vulleumier heat pump is disclosed in U.S. Pat. No. 1,275,507. This conventional heat pump has a pair of cylinders disposed opposite to each other in which a pair of displacers are so accommodated as to be moved with a certain time lag between the two displacers. Working gas in the two cylinders is moved reciprocally among hot, cold and intermediate chambers through a heater, regenerator and a cooler. In this known heat pump, the two displacers are displaced by a driving shaft disposed between the two displacers via a crank mechanism.

Further, U.S. Pat. No. 3,630,041 discloses a heat pump in which two displacers are moved by two separated driving motors. In addition, U.S. Pat. No. 3,774,405 discloses a heat pump in which two permanent magnets are provided on two displacers, respectively, so that the displacers can be moved by their magnetic force. U.S. Pat. No. 3,379,026 discloses a type of heat pump in which two displacers are moved reciprocally by a force of working gas and the reciprocal movement of the displacers is transferred into a rotational movement via a crank mechanism so that a rotational force is taken out as a driving force for an external mechanical apparatus. Moreover, a conventional heat pump in which an intermediate chamber is partitioned by a floating piston is disclosed in U.S. Pat. No. 4,455,841. In addition to these conventional heat pumps, U.S. Pat. No. 4,024,727 discloses a heat pump in which a cold displacer functions as a free piston and is supported by a gas spring so that the cold displacer is moved due to a difference in area receiving pressure of working gas.

In these conventional heat pumps, crank mechanisms are provided therein and at least one displacer is moved by an outer mechanical force or a magnetic force. Therefore, the construction of each heat pump becomes complexed and each heat pump cannot be operated without an outer driving source.

SUMMARY OF THE INVENTION

It is an object of this invention to provide a heat activated heat pump having a simple construction and capable of being operated by only a heat source without a mechanical driving force and of ensuring a high efficiency.

According to this invention, there is provided a heat activated heat pump for converting thermal energy of a heat source into compression and expansion energy of working gas to pump heat, which comprises: (a) casing means filled with working gas therein; (b) hot cylinder means accommodated in the casing means on its one side; (c) cold cylinder means accommodated in the casing means on its other side; (d) hot displacer means received slidably in the hot cylinder means so that a hot chamber is formed on the side opposite to the cold cylinder means with respect to the hot displacer means and that an intermediate chamber is formed on the side of the cold cylinder means with respect to the hot displacer means; (e) working gas passage means on the hot side, communicating between the hot and intermediate chambers; (f) hot heat exchanger means, hot regenerator means and intermediate heat exchanger means on the hot side arranged in the working gas passage means on the hot side in this order in the direction from the hot chamber to the intermediate chamber; (g) cold displacer means received slidably in th cold cylinder means so that a cold chamber is formed on the side opposite to the hot cylinder means with respect to the cold displacer means and that the intermediate chamber is formed on the side of the hot cylinder means; (h) working gas passage means on the cold side, communicating between the cold and intermediate chambers; (i) cold heat exchanger means, cold regenerator means and intermediate heat exchanger means on the cold side arranged in the working gas passage means on the cold side in this order in the direction from the cold chamber to the intermediate chamber; (j) guide means provided, in a fixed state, between the hot and cold cylinder means for guiding the hot and cold displacer means in their axial directions, the guide means being engaged slidably with the hot and cold displacer means so that two gas chambers are respectively formed between the two displacer means and the guide means, the two gas chambers being filled with working gas so as to function as a gas spring for oscillating the two displacer means.

The nature, utility, and further features of this invention will be more clearly apparent from the following detailed description with respect to preferred embodiments of the invention when read in conjunction with the accompanying drawings briefly described below.

DETAILED DESCRIPTION OF THE INVENTION

Figure 1:
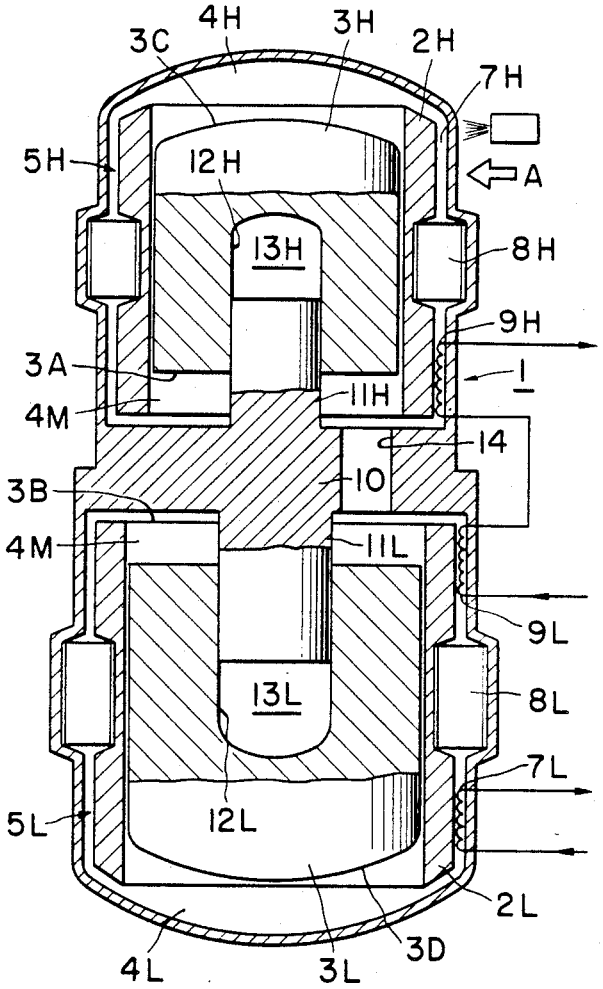
FIG. 1 is a vertically sectional view of a first embodiment of a heat pump according to this invention.

Referring to FIG. 1, a heat activated heat pump of this invention has a cylindrical casing 1 in which a hot cylinder 2H and a cold cylinder 2L are accommodated integrally and coaxially with the casing 1. In this embodiment, the diameter of the cold cylinder 2L is larger than that of the hot cylinder 2H. A working gas such as helium is contained in the casing 1.

Inside the hot cylinder 2H is slidably accommodated a hot displacer 3H outside which a hot chamber 4H is provided and inside which an intermediate chamber 4M is provided.

The hot chamber 4H is connected to the intermediate chamber 4M via a working gas passage 5H on the hot side, which is annularly formed along the outer periphery of the hot cylinder 2H. In the working gas passage 5H are provided a hot heat exchanger 7H with a burner, a hot regenerator 8H and an intermediate heat exchanger 9H on the hot side in this order as viewed in the direction from the hot chamber 4H to the intermediate chamber 4M.

The construction on the cold side is similar to that on the hot side. That is, inside the cold cylinder 2L is slidably accommodated a cold displacer 3L outside which a cold chamber 4L is provided and inside which an intermediate chamber 4M is provided. Further, the cold chamber 4L is connected to the intermediate chamber 4M via a working gas passage on the cold side which is annularly formed along the outer periphery of the cold cylinder 2L. In the gas passage 5L are provided a cold heat exchanger 7L, a cold regenerator 8L and an intermediate heat exchanger 9L on the cold side in this order as viewed in the direction from the cold chamber 4L to the intermediate chamber 4M.

Between the two cylinders 2H, 2L is provided a partition wall 10 which is formed integrally with the csaing 1. The partition wall 10 has two guide projections 11H, 11L, one of which is projected on the hot side, the other of which is projected on the cold side. In the drawing, these projections 11H, 11L are in the form of a rod and are slidably inserted into two holes 12H, 12L formed in the hot and cold displacers 3H, 3L so that two gas spring chambers 13H, 13L filled with working gas are formed in the two holes 12H, 12L, respectively. For example, helium gas is contained in the respective holes 12H, 12L. It may be possible that the partition wall 10 is formed with two holes for receiving respective two guide projections provided on the inner end surfaces of the two cylinders 3H, 3L so that two gas spring chambers are formed in the two holes. However, the type of the embodiment shown in FIG. 1 is desirable. The partition wall 10 has a connecting passage 14 for connecting the upper and lower parts of the intermediate chamber 4M with each other so that the two parts thereof can function as one intermediate chamber.

The hot heat exchanger 7H is heated by an outer heat source, that is, a burnt gas such as propane gas as indicated by an arrow A and heat is transmitted to the working gas in the casing 1 through the heat exchanger 7. The hot chamber 4H is maintained at a high temperature by the heat exchanger 7H. The intermediate heat exchanger 9H is cooled by an outer cooling source such as city water so that the working gas in the casing 1 is cooled down to an intermediate temperature such as 40° C.

The working gas can flow freely in the respective working gas passages 5H, 5L in the two (upper and lower) directions. There only exist respective pressure differences between the hot and intermediate chambers and between the intermediate and the cold chambers due to respective pressure decreases of the working gas flowing through the respective working gas passages 5H, 5L.

The two regenerators 8H, 8L are made of material having a high regenerative ability for outputting or discharging heat stored therein to the working gas passing therethrough and for absorbing heat from the working gas.

Figure 2:
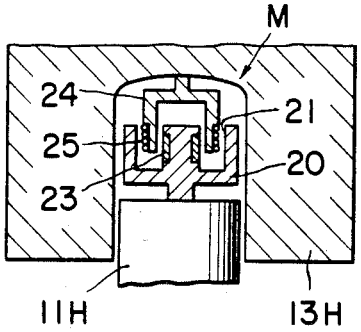
FIG. 2 is a schematic view of a gas spring chamber.

In the gas spring chamber 13H on the hot side is formed a driving mechanism M for giving an initial movement to the hot displacer 3H as shown in FIG. 2 when the operation of the heat pump is started. The driving mechanism M has a holder 20 fixed to the end surface of the guide projection 11H. The holder 20 is provided with an annular recess 21 on the inner surface of which a permanent magnet 23 is embedded. In the recess 21 is inserted a support sleeve 24 with coils 25. The sleeve 24 is hung from the upper surface of the spring chamber 13H. When electric current flows through the coils 25, the hot displacer 13H starts oscillation.

The operation of the apparatus will now be explained.

As mentioned above, the hot and cold displacers 3H, 3L are supported by the gas spring in the two gas spring chambers 13H, 13L so as to form a spring-mass system. The hot chamber 4H, the intermediate chamber 4M and the cold chamber 4L are connected to each other through the working gas passages 5H, 5L. There only exist pressure differences among respective chambers due to pressure decreases in the working gas passages 5H, 5L and the pressure of the working gas can be almost deemed as uniform at all places in the casing 1.

In both hot and cold displacers 3H, 3L, the inner end surfaces 3A, 3B of the displacers 3H, 3L are smaller in area than the outer end suraces 3C, 3D thereof by respective area corresponding to the cross sectional areas of the guide projections 11H, 11L. Accordingly, when the pressure of the working gas is increased, a force corresponding to a value obtained by multiplying the cross sectional area of each guide projection by an increase of its pressure is exerted on each displacer in the direction from the hot or cold chamber 4H or 4L to the intermediate chamber 4M. On the contrary, when the pressure of the working gas is described, a force corresponding to a value obtained in the above manner is exerted on each displacer in the direction away from the intermediate chamber 4M.

The working gas is maintained at a high temperature in the hot chamber 4H and at an intermediate temperature in the intermediate chmaber 4M and further at a low temperature in the cold chamber 4L, respectively.

In this state, the hot and cold displacers 3H, 3L start self-excited vibration as will be mentioned later in detail, respectively. This heat pump absorbs heat from the outside via the heat exchanger 7L on the cold side and outputs heat outward via the two intermediate heat exchanges 9H, 9L.

Throughout explanations mentioned below, for the convenience of expression, the direction from the intermediate chamber 4M to the hot chamber 4H is referred to as the upper direction while the direction from the intermediate chamber 4M to the cold chamber 4L is referred to as the lower direction.

First, what influences are exerted on the hot displacer 3H by movement of the cold displacer 3L will now be explained.

Suppose that the cold displacer 3L moves reciprocally and periodically. If the cold displacer 3L moves in the upper direction, working gas in the intermediate chamber 4M is compressed by the cold displacer 3L thereby to be partially forced through the intermediate heat exchanger 9L on the cold side or region, the cold regenerator 8L and the cold heat exchanger 7L. When the working gas passes the cold regenerator 8L, heat of the working gas is absorbed by the cold regenerator 8L thereby to be at a low temperature and the working gas then flows into the cold chamber 4L. During this step, as part of the working gas at an intermediate temperature is cooled to a low temperature, pressure of the working gas is dropped. Further, as the respective chambers 4H, 4M, 4L are communicated with each other through the working gas passages 5H, 5L, pressure of the working gas in all places in the casing 1 is decreased in a state wherein pressure of the working gas in each chamber becomes uniform with each other.

If pressure of the working gas is decreased, a force corresponding to a value obtained by multiplying a decrease of the pressure by the cross sectional area of the guide projection 11H is exerted on the hot displacer 3H in the direction away from the intermediate chamber 4M, that is, in the upper direction.

In contrast, if the cold displacer 3L is moved in the lower direction, working gas in the cold chamber 4L is compressed by the cold displacer 3L thereby to be partially forced through the cold heat exchanger 7L, the cold regenerator 8L and the intermediate heat exchanger 9L on the cold region. When the working gas passes through the cold regenerator 8L, it absorbs heat therefrom thereby to be at an intermediate temperature and then flows into the intermediate chamber 4M. During this step, as part of the working gas at a low temperature is heated to an intermediate temperature, the working gas pressure is generally increased. Further, since the respective chambers 4H, 4M, 4L are communicated with each other through the working gas passages 5H, 5L, pressure of working gas is increased in a state wherein pressure of the working gas in each chamber becomes uniform.

If pressure of working gas is increased, a force corresponding to a value obtained by multiplying an increase of the gas pressure by the cross sectional area of the guide projection 11H is exerted on the hot displacer 3H in the lower direction.

As mentioned above, it is understood that the hot displacer 3H receives a force in the same direction as that of movement of the cold displacer 3L when the cold displacer 3L is moved reciprocally.

It can be considered that the hot displacer 3H corresponds to a mass point in a spring-mass system in which working gas in the gas spring chamber 13H functions as a spring. If the hot displacer 3H receives a periodic force, it is displaced with a time-lag in response to an exerted force. However, the time-lag is not so large as displacement of the hot displacer 3H becomes reverse to the direction of a force exerted thereon. That is, deviation of the phase between the displacement of the hot displacer 3H and a force exerted thereon is within 180°. Accordingly, the hot displacer 3H receives a force in the same direction as that of the dispalcement of the cold displacer 3L. As a result, the hot displacer 3H is displaced with a certain time-lag in response to the movement of the cold displacer 3L.

What influences are exerted on the cold displacer 3L by the hot displacer 3H will now be explained.

Suppose that the hot displacer 3H moves reciprocally and periodically. If the hot displacer 3H moves in the upper direction, working gas in the hot chamber 4H is compressed by the hot displacer 3H so that part of the working gas therein is forced through the hot heat exchanger 7H, the hot regenerator 8H and the intermediate heat exchanger 9H. At this time, part of the working gas outputs heat to the hot regenerator 8H thereby to be at an intermediate temperature, and then flows into the intermediate chamber 4M. Accordingly, pressure of part of the working gas is decreased and the decrease of the pressure causes a pressure decrease of the working gas in all places in the casing 1 because the respective chambers 4H, 4M, 4L are communicated with each other. When the working gas pressure is decreased, a force corresponding to a value obtained by multiplying a presure decrease by the cross sectional area of the guide projection 11L is exerted on the cold displacer 3L in the lower direction.

In contrast, if the hot displacer 3H moves in the lower direction, working gas in the intermedite chamber 4M is compressed thereby so that part of the working gas therein is forced through the intermediate heat exchanger 9H on the hot region, the hot regenerator 8H and the hot heat exchanger 7H while receiving heat from the hot regenerator 8H. Accordingly, part of the working gas is heated to a high temperature through the hot regenerator 8H and then flows into the hot chamber 4H. During this step, as part of the working gas at an intermediate temperature is heated, pressure of the working gas in all places in the casing 1 is increased. If pressure of the working gas is increased, a force corresponding to a value obtained by multiplying a pressure increase by the cross sectional area of the guide projection 11L is exerted on the cold displacer 3L in the upper direction.

As mentioned above, if the hot displacer 3H moves reciprocally and periodically, the cold displacer 3L receives a force in the direction reverse to displacement of the hot displacer 3L.

Figure 3:
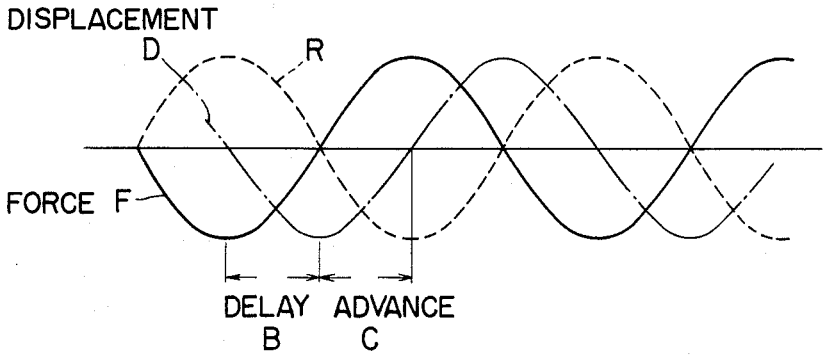
FIG. 3 is a view showing waveforms for oscillation in a spring-mass system.

The cold displacer 3L corresponds to a mass point in a spring mass system as in the case of the hot displacer 3H and is displaced with a time-lag in response to a force exerted thereon. However, the time-lag is not so long as displacement of the cold displacer 3L becomes reverse to the direction of the force exerted thereon. In other words, if a mass point in a spring-mas system receives a periodic force, the mass point is displaced ahead of a waveform of a force in the direction reverse to that of the periodic force actually exerted thereon. This relationship is shown in FIG. 3. That is, displacement of the mass point is delayed by a time-lag or delay B with respect to a periodic force F actually exerted on the mass point and, however, is ahead, by a time advance C, of the waveform R of a force in the direction reverse to the periodic force F. Accordingly, displacement of the cold displacer 3L is ahead of a waveform of a force in the direction reverse to that of an actual force exerted thereon. In addition, since the direction of a force exerted on the hot displacer 3H is reverse to that of a force exerted on the cold displacer 3L when the hot displacer 3H is moved, the cold displacer 3L is displaced ahead of the waveform of the displacement of the hot displacer 3H.

As mentioned above, the following matters can be concluded.

(a) If the cold displacer 3L moves periodically, the hot displacer 3H is displaced behind displacement of the cold displacer 3L with a certain waveform following a waveform of displacement of the cold displacer 3L.

(b) If the hot displacer 3H moves periodically, the cold displacer 3L is displaced ahead of displacement of the hot displacer 3 with a certain waveform ahead of a waveform of displacement of the hot displacer 3H.

Accordingly, in both cases of the periodic movements of the cold and hot displacers 3L, 3H, a relative relationship with respect to the movements of the two displacers 3H, 3L is the same and displacement of the cold displacer 3L is always ahead of that of the hot displacer 3H.

Further, as the two hot and cold displacers 3H, 3L are supported by gas springs in the casing 1, when some external force such as impact force or magnetic force by artificial means is exerted on the two displacers 3H, 3L, the two displacers 3H, 3L oscillate continuously even after the external force is removed. In this oscillation, displacement of the cold displacer 3L is ahead of that of the hot displacer 3H. Moreover, this oscillation is attenuated and finally stopped due to frictional forces between the displacers 3H, 3L, the cylinders 2H, 2L and the guide projections 11H, 11L and resistances in the working gas passages 5H, 5L if working gas does not produce a force for continuing movement of the two displacers 2H, 2L.

In this heat activated heat pump, the oscillation of the two displacers 3H, 3L can continue without its attenuation under influence of working gas exerted on the two hot and cold displacers 3H, 3L even after the above external force is removed.

If an external force is exerted on either the hot displacer 3H or cold displacer 3L, the two dislacers 3H, 3L start to oscillate in the manner that displacement of the cold displacer 3L is ahead of that of the hot displacer 3H with a time advance C.

The operation of this heat pump in the region from an instant a to an instant h (one cycle) in FIG. 4 will now be explained with reference to FIGS. 5A to 5H. The steps of the instant a to the instant h correspond to the steps of FIG. 5A to FIG. 5H, respectively.

Figure 5A:
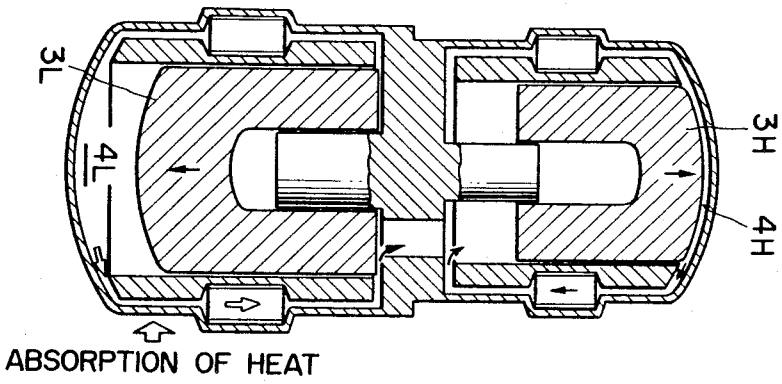
FIGS. 5A to 5H are vertically sectional views of the first embodiment of the heat pump, showing some processes in one operational cycle of the heat pump; respectively.
Figure 5B:
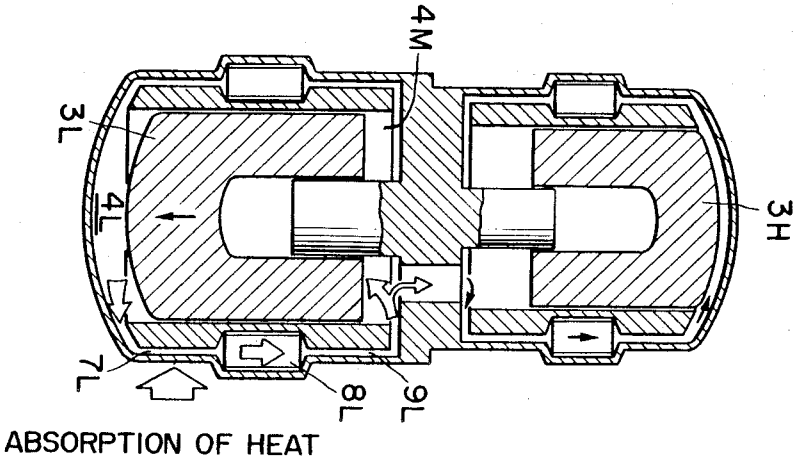
Figure 5C:
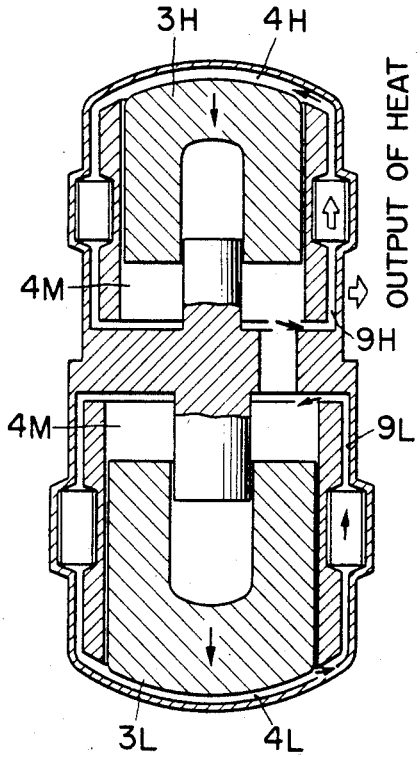

(I) Regarding the steps of the instants a to c (FIGS. 5A to 5C)

In this region, the hot displacer 3H changes its course from the upper direction to the lower direction. However, since amplitude of movement of the hot displacer 3H in this region is small, working gas is little affected by the movement of the hot displacer 3H and is much affected by the cold displacer 3L moving in the lower direction. In the step of FIG. 5A, volume of working gas in the hot chamber 4H is reaching a minimum and volume of working gas in the cold chamber 4L is decreasing from a maximum. Therefore, FIG. 5A shows a state wherein working gas is most deviated to the cold region, that is, pressure of the working gas is decreased to a minimum.

Figure 4:
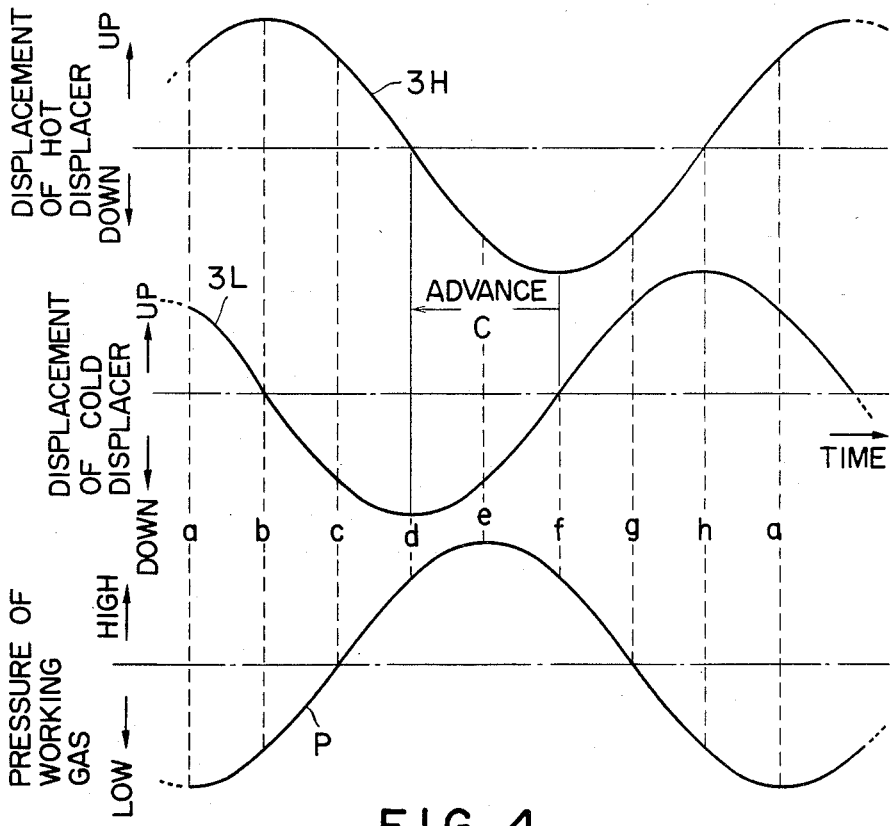
FIG. 4 is a view showing a relationship between displacement of hot and cold displacers and change of working gas pressure.

At the instant b in FIG. 4, the cold displacer 3L is moving in the lower direction as shown in FIG. 5B. At this time, the cold working gas in the cold chamber 4L is forced through the cold heat exchanger 7L, the cold regenerator 8L and the intermediate heat exchanger 9L on the cold region and absorbs heat from the outside through the cold heat exchanger 7L. Further, the cold working gas absorbs heat from the cold regenerator 8L thereby to be heated to an intermediate temperature and then flows into the intermediate chamber 4M. As a result, since part of the cold working gas is heated to the intermediate temperature, pressure of the working gas is increased as a whole. When pressure of working gas is increased as a whole, working gas accommodated in the intermediate chamber 4M in the state of FIG. 5A is also compressed thereby to increase pressure of working gas therein. Accordingly, in the intermediate chamber 4M, there occurs a change of condition similar to adiabatic compression thereby to raise temperature of the inside of the intermediate chamber 4M. A quantity of heat corresponding to the rise of the temperature therein is output or discharged to the external cold heat source through the two intermediate heat exchangers 9H, 9L during the successive steps.

The greater the temperature difference between the cold and intermediate chambers 4L, 4M is, the greater the increase of the gas pressure during the steps of FIGS. 5A to 5C is. Accordingly, in the step of FIG. 5B, the greater the temperature difference between the cold and the intermediate chambers 4L, 4M is, the greater the quantity of heat discharged from the intermediate heat exchangers 9H, 9L is.

Figure 5D:
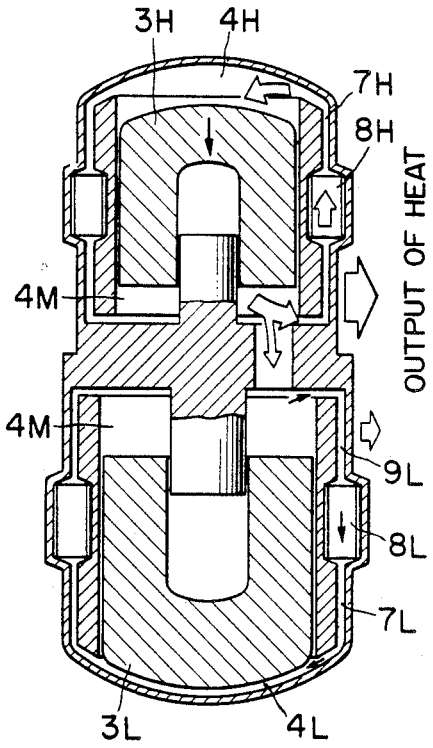
Figure 5E:
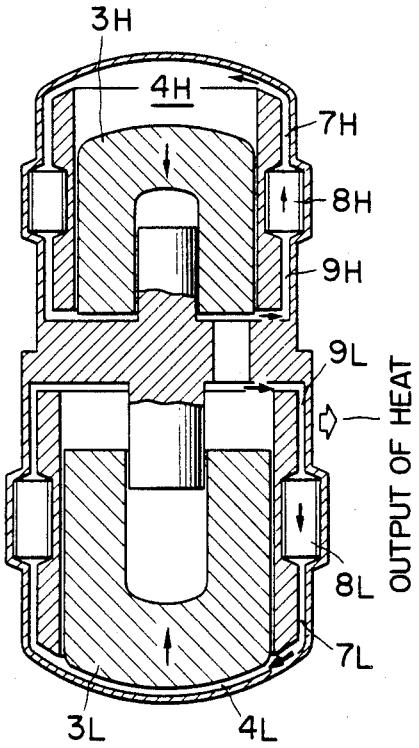

(II) Regarding the steps of the instants c to e (FIGS. 5C to 5E)

In this region, the cold displacer 3L changes its course from the lower direction to the upper direction. However, since the amplitude of movement of the cold displacer 3L in this region is small, working gas is little affected by the movement of the cold displacer 3L and is affected by the hot displacer 3H moving in the lower direction. In the step of FIG. 5C, respective volumes of the hot and cold chambers 4H, 4L are almost reaching their minimum values while volume of the intermediate chamber 4M reaches a maximum value. Therefore, FIG. 4C shows a state wherein pressure of working gas reaches a value close to its average value.

In the step of FIG. 5D wherein the hot displacer 3H moves in the lower direction, working gas at an intermediate temperature in the intermediate chamber 4M is compressed by the hot displacer 3H so that part of the working gas therein is forced through the intermediate heat exchanger 9H in the hot region, the hot regenerator 8H and the hot heat exchanger 7H. Then, a quantity of heat corresponding to the rise of the temperature of the intermediate chamber 4M during the process (I) is discharged from the intermediate heat exchanger 9H. The working gas abosrbs heat from the hot regenerator 8H to be heated to a high temperature and flows into the hot chamber 4H. As a result, since part of the working gas at an intermediate temperature is heated to a high temperature, pressure of the working gas is increased, as a whole, following the above process (I). In this manner, in the steps wherein pressure of working gas is increased, pressure of the working gas accommodated in the intermediate and cold chambers 4M, 4L in the step of FIG. 4C is also increased whereby part of the working gas in the intermediate chamber 4M is fed into the cold chamber 4L. At this time, a quantity of heat corresponding to rise of the temperature during the process (I) is partially discharged from the intermediate heat exchanger 9L. At the same time, there occurs a change of condition similar to adiabatic compression in the intermediate chamber 4M. A quantity of heat corresponding to the increase of the gas temperature is discharged from the intermediate heat exchanger 9L to the cold heat source through the successive steps.

During the steps of FIGS. 5C to 5E, the greater the temperature difference between the intermediate and the hot chambers 4M, 4H is, the greater the increase of the gas pressure is. Therefore, the greater the temperature difference between the intermediate and hot chambers 4M, 4H is, the greater the rise of the gas temperature in the intermediate chamber 4M during these steps of FIGS. 5C to 5E is.

Figure 5F:
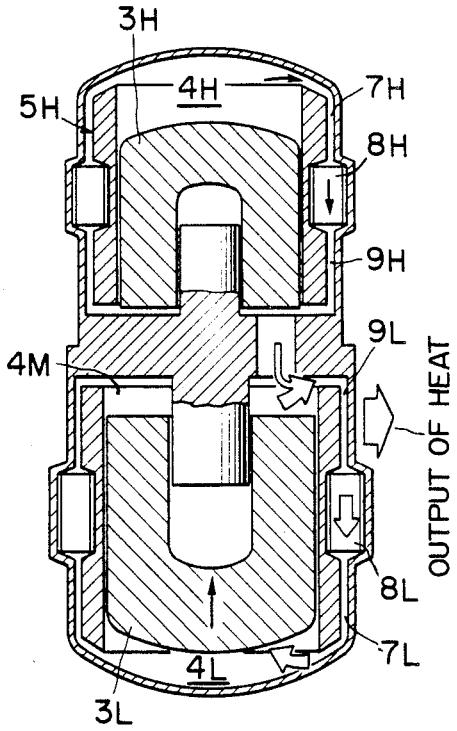
Figure 5G:
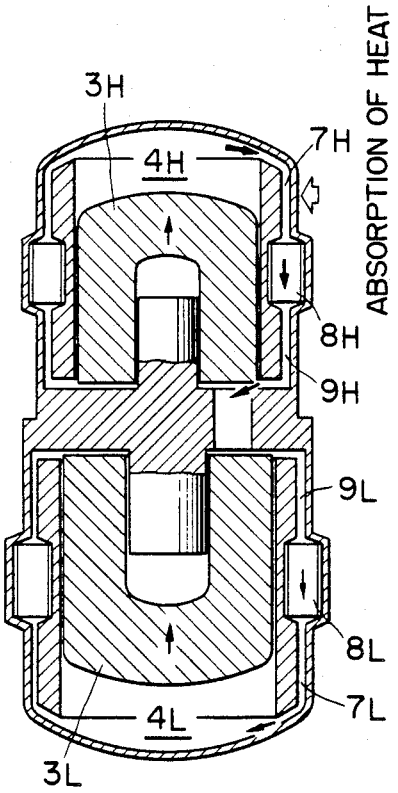

(III) Regarding the steps of the instants e to g (FIGS. 5E to 5G)

In these steps, the hot displacer 3H changes its course from the lower direction to the upper direction. However, since the amplitude of movement of the hot displacer 3H in this region is small, working gas is little affected by the movement of the hot displacer 3H and is much affected by the cold displacer 3L moving in the upper direction.

In the step of FIG. 5E, volume of working gas in the hot chamber 4H is reaching a maximum while volume of working gas in the hot chamber 4L is being gradually increased from a minimum. Therefore, FIG. 5E shows a state wherein working gas is most deviated from the cold region to the hot region, that is, pressure of the working gas reaches a maximum in a cycle.

In the step of FIG. 5F wherein the cold displacer 3L moves in the upper direction, working gas at an intermediate temperature in the intermediate chamber 4M is compressed by the cold displacer 3L so that part of the working gas is forced through the intermediate heat exchanger 9L on the cold region, the cold regenerator 8L and the cold heat exchanger 7L. At this time, a quantity of heat corresponding to the rise of the gas temperature in the intermediate chamber 4M is discharged therefrom to the intermediate heat exchanger 9L on the cold region. Further, heat of the working gas is absorbed by the cold regenerator 8L to be cooled to a low temperature and then flows into the cold chamber 4L. As a result, since the working gas at an intermediate temperature is partially cooled to. a low temperature, pressure of the working gas is decreased as a whole. In this state wherein the gas pressure is decreased, working gas in the hot chamber 4H is forced through the working gas passage 5H to flow into the intermediate chamber 4M with a pressure decrease. In this manner, pressure of all working gas is decreased. That is, in these steps, the working gas is drawn therefrom in a state wherein volume of the hot chamber 4H being little changed, to cause a change of the condition similar to adiabatic expansion in the hot chamber 4H whereby temperature of the hot chamber 4H is decreased. A quantity of heat corresponding to the decrease of the temperature is given or output from the hot heat source to the working gas via the hot heat exchanger 7H. The greater the temperature difference between the cold and intermediate chambers 4L, 4M is, the greater the pressure decrease through the steps of FIGS. 5E to 5G is. Therefore, in these steps, the greater the temperature difference between the cold and intermediate chambers 4L, 4M is, the greater the temperature drop, that is, quantity of heat absorbed from the hot heat exchanger 7H through the successive steps is.

Figure 5H:
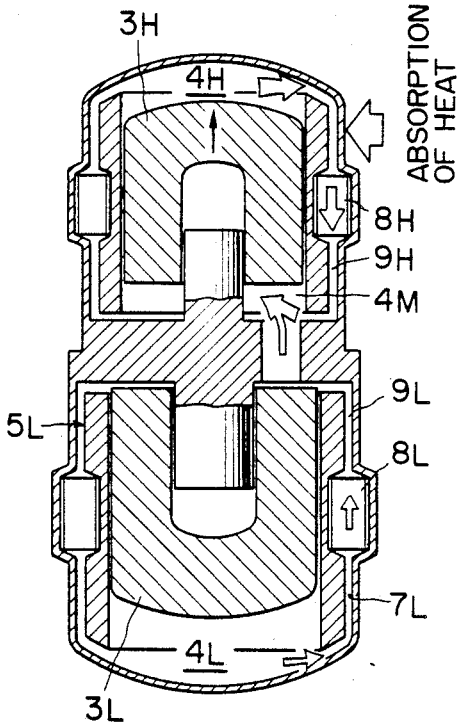

(IV) Regarding the instants g to h (FIGS. 5G to 5H)

In these steps, the cold displacer 3L changes its course from the upper direction to the lower direction. However, since the amplitude of movement of the displacer 3L in this region is small, the working gas is little affected by the movement of the hot displacer 3L and is much affected by the hot displacer 3H moving in the upper direction.

In the state of FIG. 5G, the respective volumes of the cold and hot chambers 4L, 4H reach their maximum values and the gas pressure in the two chambers 4L, 4H almost reaches an average value. In the step of FIG. 5H wherein the hot displacer 3H moves in the upper direction, working gas at a high temperature in the hot chamber 4H is compressed thereby to be partially forced through the hot heat exchanger 7H, the hot regenerator 8H and the intermediate heat exchanger 9H in this order. At this time, the working gas absorbs a quantity of heat corresponding to the temperature drop of the hot chamber 4H through the above process (III) from the hot heat exchanger 7H, and then outputs heat to the hot regenerator 8H thereby to be cooled to an intermediate temperature. Thereafter, the working gas flows into the intermediate chamber 4M. As a result, since the working gas at a high temperature is cooled partially to an intermediate temperature, the gas pressure is decreased following the above process (III). At this time, pressure of working gas in all places in the casing 1 is decreased and the working gas in the cold chamber 4L partially flows into the intermediate chamber 4M through the working gas passage 5L with a pressure decrease in the cold chamber 4L. Therefore, in these steps, part of the cold chamber 4L. Therfore, in these steps, part of working gas in the cold chamber 4L is drawn therefrom in a state wherein the volume of the cold chamber 4L is little changed. At this time, there occurs a change of condition similar to adiabatic expansion in the cold chamber 4L thereby to decrease the temperature of the cold chamber 4L. Further, the working gas absorbs a quantity of heat corresponding to the temperature drop from the cold heat exchanger 7L through the successive steps.

The greater the temperature difference between the hot and intermediate chambers 4H, 4M is, the greater the pressure decrease through the steps 5G to 5A is. Therefore, the greater the temperature difference therebetween is, the greater the temperature drop of the cold chamber 4L, that is, quantity of heat absorbed from the cold heat exchanger 7L through the successive steps is.

The above shows a series of changes of conditions of the heat pump during one cycle in which the hot and cold displacers 3H, 3L move reciprocally.

The processes (I to (IV) will now be explained in short.

(A) Effect of working gas to the two displacers

Pressure of working gas changes in one cycle in such a manner that its pressure is at a minimum value, in the step of FIG. 5A, at an intermediate value in the step of FIG. 5C, at a maximum value in the step of FIG. 5E and again at an intermediate value of FIG. 5G. A relationship among displacements of the hot and cold displacers 3H, 3L and pressure of working gas is shown in FIG. 4.

The hot and cold displacers 3H, 3L receive the following forces due to difference of pressure receiving area between those outer and inner end surfaces, respectively.

(a) Since pressure of working gas is higher than the average value in the region of the instants c to g of FIG. 4, both of the hot and cold displacers mainly receive a force from the working gas in the direction from the opposite ends of the casing 1 to the intermediate chamber 4M. That is, the hot displacer 3H receives a force in the lower direction and the cold displacer receives a force in the upper direction. In this region, the hot displacer 3H moves mainly in the lower direction and working gas functions to accelerate movement of the hot displacer 3H in the lower direction. Further, the cold displacer 3L moves mainly in the upper direction in this reigon and the working gas functions to accelerate movement of the cold displacer 3L in the upper direction.

(b) Since pressure of working gas is lower than the average value in the region of the instants g to c, the two displacers receive a force in the direction reverse to that in the case of (a), that is, the hot dispalcer 3H receives a force in the upper direction while the cold displacer 3L receives a force in the lower direction.

The hot displacer 3H moves mainly in the upper direction in this region and working gas functions to accelerate upper movement of the hot displacer 3H. In addition, the cold displacer moves mainly in the lower direction in this region and the working gas functions to accelerate lower movement of the cold displacer. Accordingly, it is understood that movement of the hot and cold displacers can be promoted by effect of working gas.

Figure 6A:
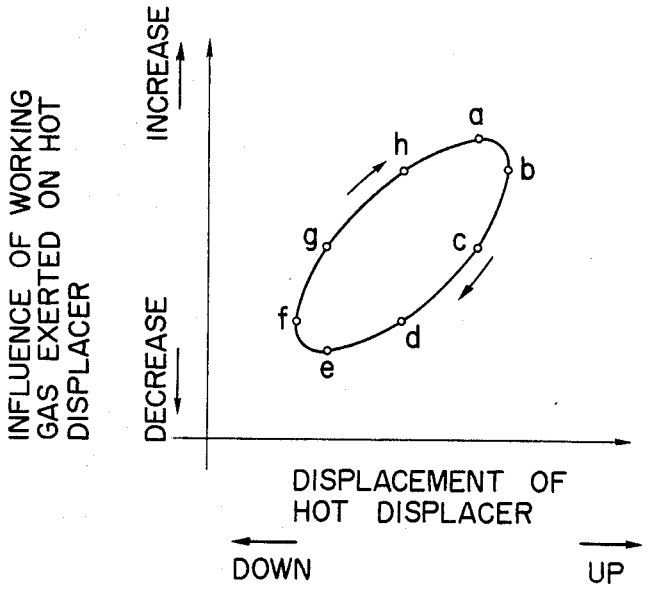
FIG. 6A is a diagram showing a relationship between displacement of a hot displacer and a force exerted thereon by working gas.
Figure 6B:
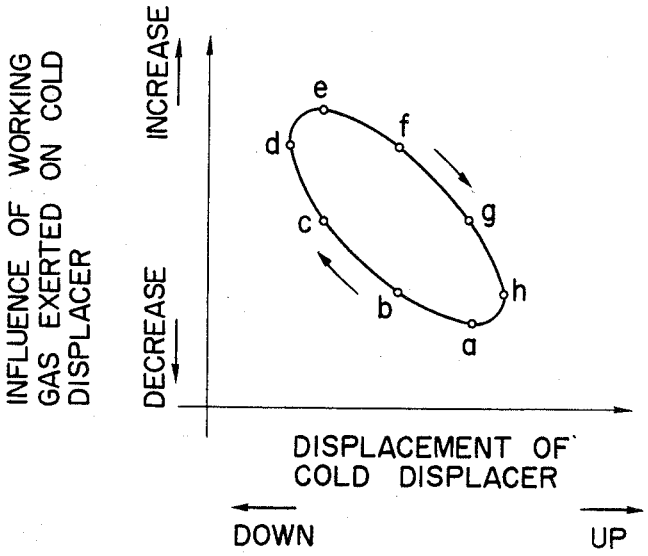
FIG. 6B is a diagram showing a relationship between displacement of a cold displacer and force exerted thereon by working gas.

FIGS. 6*a* is a diagram showing a relationship between displacement of the hot displacer 3H and force exerted thereon by working gas and FIG. 6B is a diagram showing a relationship between displacement of the cold displacer and force exerted thereon by working gas. In these drawings, letters a to h correspond to the instants a to h of FIG. 4, respectively. Each of the hot and cold displacers 3H, 3L receives energy corresponding to area in each ellipse. The hot and cold displacers 3H, 3L move continuously and reciprocally in a state wherein the force from working gas compensates for attenuation elements due to respective frictions between the guide projections 11H, 11L and the displacers 3H, 3L and between the displacers 3H, 3L and the cylinders 2H, 2L and due to flow resistance of working gas in the working gas passages 5H, 5L.

(B) Exchange of heat in the heat exchangers

Exchange of heat in the steps of the instants a to h (FIGS. 5A to 5H) is as follows.

(a) Working gas absorbs a quantity of heat corresponding to expansion work done through the instants h to a in the cold chamber 4L, from the cold heat exchanger 7L through the instants a to c. The quantity of heat is in proportion to the temperature difference between the hot and intermediate chambers 4H, 4M. At the same time, working gas in the intermediate chamber 4M is compressed by an increase of its pressure.

(b) Working gas outputs a quantity of heat corresponding to compression work done through the instants a to c in the intermediate chamber 4M mainly via the intermediate heat exchanger 9H on the hot side through the instants c to e. The quantity of heat is in proportion to the temperature difference between the cold and intermediate chambers 4L, 4M. At the same time, working gas in the intermediate chamber 4M is compressed by an increase of its pressure following the instants a to c.

(c) Working gas outputs a quantity of heat corresponding to compression work done through the instants c to e via the intermediate heat exchanger 9L on the cold side through the instants e to g. The quantity of heat is in proportion to the temperature difference between the hot and cold chambers 4H, 4M. At the same time, working gas in the hot chamber is expanded to be partially discharged therefrom to the intermediate chamber 4M.

(d) Working gas absorbs a quantity of heat corresponding to expansion work in the hot chamber 4H through the instants e to g via the hot heat exchanger 7H through the instants g to a. The qauntity of heat is in proportion to temperature difference between the intermediate and cold chambers 4M, 4L. At the same time, working gas in the cold chamber 4L is expanded to be partially discharged therefrom to the intermediate chamber 4M. A quantity of heat corresponding to expansion working of the working gas in the cold chamber 4L is absorbed by working gas via the cold heat exchanger 7L through the instants a to c.

The following matters can be said on the basis of the above explanation.

(i) Working gas absorbs a quantity of heat in proportion to the temperature difference between the intermediate and cold chambers 4M, 4L through the hot heat exchanger 7H.

(ii) Working gas outputs a quantity of heat in proportion to the temperature difference between the intermediate and the cold chambers 4M, 4L through the intermediate heat exchanger 9H on the hot side.

(iii) Working gas outputs a quantity of heat in proportion to the temperature difference between the hot and intermediate chambers 4H, 4M through the intermediate heat exchanger 9L.

(iv) Working gas absorbs a quantity of heat in proportion to the temperature difference between the hot and intermediate chambers 4H, 4M through the cold heat exchanger 7L.

As mentioned above, this apparatus functions as a heat pump. Further, in this heat pump, (i) A quantity of heat corresponding to the temperature difference between the hot and intermediate chamber 4H, 4M is pumped up from the temperature level of the cold chamber 4M to that of the intermediate chamber 4M.

(ii) Energy necessary for the above pumping operation is in proportion to the temperature difference between the intermediate and cold chambers 4M, 4L, that is, head (lift) of temperature for the pumping up.

(iii) Accordingly, (1) The higher the temperature level on the output side of pumping operation, that is, temperature of the intermediate chamber 4M is, the lower the ratio of quantity of heat to be pumped up to energy to be input is.

(2) The higher the temperature of the hot chamber 4H is, the higher the ratio of quantity of heat to be pumped up to energy to be input is.

(3) The lower the temperature level on the input side of the pumping operation, that is, temperature of the cold chamber 4L is, the lower the ratio of quantity of heat to be pumped up to energy to be input is.

As mentioned above, in this heat pump, working gas is heated or cooled by a hot or cold heat source to cause an increase or drop of working gas pressure whereby the working gas is compressed or expanded without a mechanical driving force while absorbing or outputting heat. Accordingly, the heat pump of this invention can operate without an outer mechanical driving force such as a floating piston causing an energy loss thereby to ensure a high efficiency and to simplify its construction remarkably.

Figure 7:
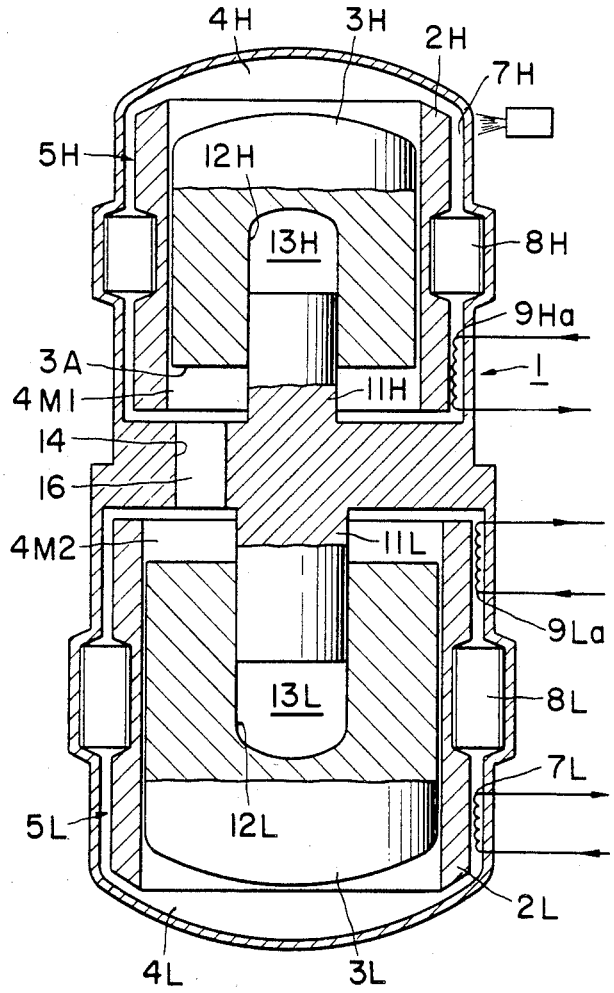
FIG. 7 is a vertically sectional view of a second embodiment of this invention.

FIG. 7 shows a second embodiment of this invention. In this modified heat pump, an itermediate regenerator 16 is inserted into the connecting passage 14 of the partition wall 10 so as to divide the intermediate chamber into upper and lower intermediate chambers $4M_1$, $4M_2$. Further, an intermediate heat exchanger 9H*a* on the hot side is separated from an intermediate heat exchanger 9L*a* on the cold side so that their temperature levels are different from each other. Accordingly, temperature of the upper intermediate chamber $4M_1$ is different from that of the lower intermediate chamber $4M_2$.

Working gas can flow freely through the intermediate regenerator 16. Accordingly, pressure of working gas in all chambers can be considered as uniform.

The intermediate regenerator 16 absorbs heat of working gas flowing from the high temperature side to the low temperature side so that heat accumulating material of the regenerator 16 accumulates heat once to drop temperature of the working gas to a temperature on the low temperature side while the intermediate regenerator 16 outputs heat stored therein once to working gas flowing from the lower temperature side to the high temperature side to raise temperature of the working gas to a temperature on the high temperature side. That is, the intermediate regenerator 16 functions to maintain the temperature difference between the upper and lower intermediate chambers $4M_1$, $4M_2$. Therefore, the upper intermediate chamber $4M_1$ is maintained at a temperature higher than that of the lower intermediate chamber $4M_2$.

In this embodiment, the two displacers oscillate in the same manner as the first embodiment shown in FIG. 1 because a state of interference of the two displacers 3H, 3L and a relative relationship between displacement of the two displacers 3H, 3L and pressure of working gas are the same as those in the first embodiment.

Exchange of heat in heat exchagners of the second embodiment is as follows.

(i) Working gas absorbs a quantity of heat in proportion to the temperature difference between the lower intermediate chamber $4M_2$ and the cold chamber 4L through the hot heat exchanger 7H.

(ii) Working gas outputs a quantity of heat in proportion to the temperature difference between the intermediate chamber $4M_2$ on the cold side and the cold chamber 4L through the intermediate chamber 9Ha on the hot side.

(iii) Working gas outputs a quantity of heat in proportion to the temperature difference between the intermediate chamber $4M_1$ and the hot chamber 4H through the intermediate heat exchanger 9La on the cold side.

(iv) Working gas absorbs a quantity of heat in proportion to the temperature difference between the intermediate chamber $4M_1$ on the hot side and the hot chamber 4H through the cold heat exchanger 7L.

Accordingly, in the heat pump of the second embodiment, (i) a quantity of heat in proportion to the temperature difference between the intermediate chamber $4M_1$ on the hot side and the hot chamber 4H is pumped up from temperature level of the cold chamber 4L.

(ii) Energy necessary for the above pumping operation is in proportion to the temperature difference between the intermediate chamber $4M_2$ on the cold side and the cold chamber 4L.

(iii) Heat pumped up is output at two different levels, that is, two temperatures of the upper and lower intermediate chambers $4M_1$, $4M_2$.

Regarding quantity of heat output.

(1) The less the temperature difference between the intermediate chamber $4M_2$ on the cold side and the cold chamber 4L is, the less the quantity of heat to be output at a temperature level of the hot chamber 4H is.

(2) The less the temperature difference between the intermediate chamber $4M_1$ on the hot side and the hot chamber 4H is, the less the quantity of heat to be output at a temperature level of the intermediate chamber $4M_2$ on the cold side is.

In this manner, if the intermediate chamber is divided into two upper and lower chambers $4M_1$, $4M_2$ having two different temperature levels and temperature of the upper chamber $4M_1$ is equalized to that of the intermediate chamber 4M of the first embodiment while temperature of the lower chamber $4M_2$ is determined at a temperature lower than that of the intermediate chamber 4M, the heat pump of the second embodiment can pump up the same quantity of heat as that of the first embodiment from the cold chamber 3L at the same temperature level as that of the cold chamber 3L of the first embodiment by energy smaller than that of the first embodiment. Further, the heat pump of the second embodiment can output heat at the same temperature level as that of the first embodiment and however quantity of heat at that time is less as compared with the first embodiment because volume of the upper chamber $4M_1$ is less than that of the intermediate chamber 4M.

In addition, if temperature of the upper chamber $4M_1$ is equalized to temperature of the intermediate chamber 4M of the first embodiment, temperature of the lower chamber $4M_2$ is determined at a temperature lower than that of the intermediate chamber 4M thereof and temperature of the cold chamber 4L is determined at a temperature lower than that of the cold chamber 4L thereof, the heat pump of the second embodiment can pump up the same quantity of heat as in the case of the first embodiment from a lower temperature level by the same quantity of energy.

Figure 8:
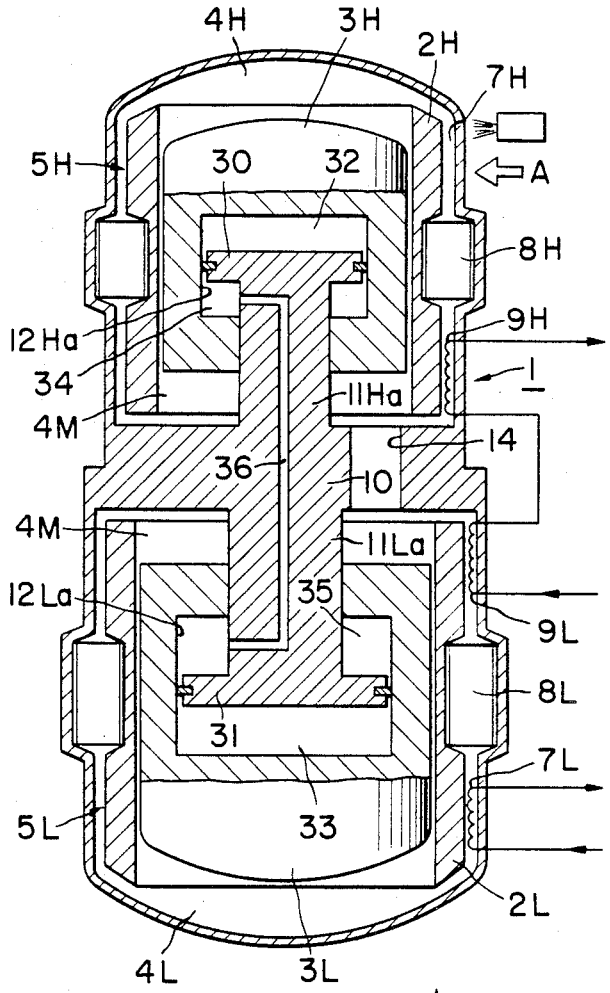
FIG. 8 is a vertically sectional view of a third embodiment of this invention.
Figure 9:
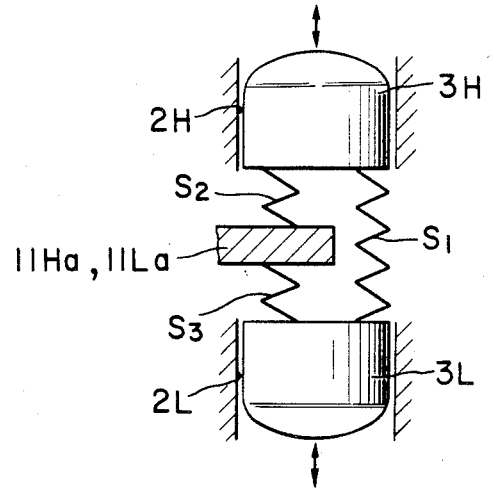
FIG. 9 is a schematic view showing a principle of the third embodiment.

FIGS. 8 and 9 show a third embodiment and a principle of its operation, respectively.

The partition wall 10 has an upper guide projection 11H*a* and a lower guide projection 11L*a* which have two piston portions 30, 31 at their outer ends, respectively. The piston portion 30 is slidably engaged with the inner surface of a gas spring chamber 12H*a* formed in the hot displacer 3H while the piston portion 31 is slidably engaged with the inner surface of a gas spring chamber 12L*a* formed in the cold displacer 3L. The two gas spring chambers 12H*a*, 12L*a* are filled with working gas such as helium and partitioned by the respective piston portions 30, 31 to form two main spring chambers 32, 33 outside the respective piston portions 30, 31 and two relative spring chambers 34, 35 inside the respective piston portions 30, 31, respectively. The two relative spring chamber 34, 35 are communicated with each other through a communicating passage 36 formed in the two projections 11H*a*, 11L*a* so as to interfere relative oscillation of the two displacers 3H, 3L. The main gas chambers 32, 33 function independently of each other. The two relative spring chambers 34, 35 form a relative gas spring $S_1$ while the two main spring chambers 32, 33 form two main gas springs $S_2$, $S_3$, respectively.

A relative relationship among displacements of the cold and hot displacers 3H, 3L, spring force of the relative gas spring $S_1$ and direction of force exerted by the spring $S_1$ on the cold and hot displacers 3H, 3L is described in a table mentioned below on the basis of FIG. 4.

TABLE

| items | steps | | | | | | | |
|---|---|---|---|---|---|---|---|---|
| | h | a | b | c | d | e | f | g |

TABLE-continued

| items | | | | | | | |
|---|---|---|---|---|---|---|---|
| displacement of cold displacer | | | descent | | rise | | |
| displacement of hot displacer | | rise | | descent | | rise | |
| spring force of relative gas spring | | weak | | strong | | weak | |
| direction of force of relative gas spring | cold displacer | lower direction | | upper direction | | lower direction | |
| | hot displacer | upper direction | | lower direction | | upper direction | |

Spring force of the relative gas spring $S_1$ is strong or large when the distance between the two displacers 3H, 3L is long during their oscillation because total volume of the relative gas spring chambers 34, 35 is small at that time while the spring force thereof is weak or small when the distance therebetween is short. When working gas of the relative gas spring chambers is compressed, that is, the distance between the two displacers 3L, 3H is long, the cold displacer 3L receives a force in the upper direction while the hot displacer 3H receives a force in the lower direction. On the contrary, when working gas of the relative gas spring chambers 34, 35 is expanded, that is, the distance therebetween is short, the cold displacer 3L receives a force in the lower direction while the hot displacer 3H receives a force in the upper direction because of negative pressure in the two relative spring chambers 34, 35.

According to the table, the hot displacer 3H receives mainly a force in the lower direction during descent movement of the hot displacer 3H and a force in the upper direction during rising movement of the hot displacer 3H. Accordingly, movement of the hot displacer 3H is accelerated or promoted by the relative gas spring $S_1$. However, the cold displacer 3L receives mainly a force in upper direction during descent movement of the cold displacer 3L and a force in the lower direction during rising movement thereof. Accordingly, movement of the cold displacer is restricted by the relative gas spring $S_1$.

In addition to influence of the relative gas spring $S_1$, influence of the main gas springs $S_2$, $S_3$ is exerted on the two displacers 3H, 3L. Further, reciprocal movement of the hot displacer 3H causes a change of pressure of working gas which promotes movement of the cold displacer 3L. Accordingly, if a force for promoting movement of the cold displacer 3L due to the change of pressure of working gas is greater than a force for restricting movement of the cold displacer 3L due to effect of the relative gas spring $S_1$, the former force can compensate for the latter force thereby to cause continuous movement of the cold displacer 3L. Spring force of the relative gas spring $S_1$ must be adjusted in such a manner.

In general, the two displacers 3L, 3H can move reciprocally when the cold chamber 4L reaches a relative low temperature after the heat pump starts its operation. Accordingly, before the heat pump reaches its stable operation, the cold chamber 4L must be cooled or the displacers 3H, 3L must be moved by an outer driving force. Further, in the first embodiment without the relative gas spring $S_1$, since the two displacers 3H, 3L are supported independently of each other by the two gas springs in the two chambers 13H, 13L, a force for interfering the two displacers 3H, 3L is relatively weak. Accordingly, movement of the two displacers 3H, 3L is apt to be much affected by change of temperature of the heat exchangers 7L, 9L. However, in the above manner, if the relative gas spring $S_1$ is provided, the relative gas spring $S_1$ can compensate for influence due to change of temperature of the cold chamber 4L whereby the two displacers can move reciprocally in a stable manner.

What is claimed is:

1. A heat activated heat pump for converting thermal energy of heat sources into compression and expansion energy of working gas to pump heat, which comprises:

(a) casing means filled with working gas therein;

(b) hot cylinder means accommodated in the casing means on its one side;

(c) cold cylinder means accommodated in the casing means on its other side;

(d) hot displacer means received slidably in the hot cylinder means so that a hot chamber is formed on the side opposite to the cold cylinder means with respect to the hot displacer means and that an intermediate chamber is formed on the side of the cold cylinder means with respect to the hot displacer means;

(e) working gas passage means on the hot side communicating between the hot and intermediate chambers;

(f) hot heat exchanger means, hot regenerator means and intermediate heat exchanger means on the hot side arranged in the working gas passage means on the hot side in this order in the direction from the hot chamber to the intermediate chamber;

(g) cold displacer means received slidably in the cold cylinder means so that a cold chamber is formed on the side opposite to the hot cylinder means with respect to the cold displacer means and that the intermediate chamber is formed on the side of the hot cylinder means;

(h) working gas passage means on the cold side communicating between the cold and intermediate chamber;

(i) cold heat exchanger means, cold regenerator means and intermediate heat exhanger means on the cold side arranged in the working gas passage means on the cold side in this order in the direction from the cold chamber to the intermediate chamber;

(j) guide means provided, in a fixed state, between the hot and cold cylinder means for guiding the hot and cold displacer means in their axial directions, the guide means being engaged slidably with the hot and cold displacer means so that two gas chambers are respectively formed between the two displacer means and the guide means, the two gas chambers being filled with working gas so as to function as a gas spring for oscillating the two displacer means.

2. A heat activated heat pump according to claim 1, wherein the guide means comprises two guide projections in the form of a rod extending toward the hot and cold displacers, respectively; and the hot and cold displacers have two holes for receiving slidably the two guide projections so as to form two gas spring chambers in their holes, respectively.

3. A heat activated heat pump according to claim 2, wherein the two guide projections are formed on a partition wall provided in a fixed state between the two cylinders; and the partition wall has at least one connecting passage for communicating, with each other, two separate portions of the intermediate chamber formed on the opposite sides of the partition wall.

4. A heat activated heat pump according to claim 1, wherein the two gas passages on the hot and cold sides are formed on the outer peripheries of the hot and cold cylinders, respectively.

5. A heat activated heat pump according to claim 2, wherein the two guide projections are formed on a partition wall provided in a fixed state between the two cylinders; the partition wall has at least one connecting pasage in which an intermediate regenerator is accommodated; and two intermediate chambers with different temperature levels are formed on the opposite sides of the partition wall, respectively.

6. A heat activated heat pump according to claim 1, wherein each of two gas chambers is divided by a piston portion formed on the guide means into two chambers, one of which forms a main gas spring chamber outside the piston portion and the other of which forms a relative gas chamber inside of the piston portion; and the respective relative gas chambers of the two gas chambers are communicated with each other through a communicating passage.

7. A heat activated heat pump according to claim 6, wherein each piston portion is formed at the outer end of a guide projection as the guide means; and the communicating passage is formed in the guide means.

* * * * *